United States Patent [19]

Foster et al.

[11] Patent Number: 4,811,435

[45] Date of Patent: Mar. 14, 1989

[54] HOSPITAL BED WITH PIVOTING HEADBOARD

[75] Inventors: L. Dale Foster, Brookville; Virgil J. Niese, Batesville, both of Ind.

[73] Assignee: Hill-Rom Company, Inc., Batesville, Ind.

[21] Appl. No.: 144,188

[22] Filed: Jan. 15, 1988

[51] Int. Cl.[4] ..... A47C 21/00

[52] U.S. Cl. ..... 5/60; 5/503; 5/508

[58] Field of Search ..... 5/60, 70–72, 5/503, 507, 508, 53 R

[56] References Cited

U.S. PATENT DOCUMENTS

| | | | |
|---|---|---|---|
| 809,352 | 1/1906 | Wright | 5/503 X |
| 3,660,591 | 5/1972 | Schultz et al. | 5/508 X |
| 4,332,042 | 6/1982 | Koncelik | 5/503 X |
| 4,720,881 | 1/1988 | Meyers | 5/508 X |

*Primary Examiner*—Alvin C. Chin-Shue

*Attorney, Agent, or Firm*—Wood, Herron & Evans

[57] ABSTRACT

A hospital bed having a pivoted headboard that functions as a work center. The headboard can be swung to either side of the bed and locked there as well as its normal position at the head of the bed.

9 Claims, 3 Drawing Sheets

HOSPITAL BED WITH PIVOTING HEADBOARD

This invention relates to a hospital bed having a headboard.

The headboard of a hospital bed currently has little function other than retaining the patient's pillow and providing structure for pushing the bed.

An objective of the present invention has been to utilize the headboard as a work center. The work center concept of the present invention involves the organization of the headboard on its surface remote from the bed (normally adjacent the bedroom wall) into compartments to contain devices useful in the treatment of patients. These include diagnostic devices such as a blood pressure cuff, a temperature indicator and a nurse's light. The invention further contemplates the mounting on that surface a computer which can include a bar code reader that will read the nurse's badge, the patient's wrist band and record the time of the nurse's call on the patient. With the bar code reader and computer, a complete record of the precise treatment given the patient as well as the recording of the vital signs, administration of medicines and the like. The headboard can also contain the nursing controls for the raising and lowering of a patient's support surface, room lighting, nurse call, T.V. and patient lock-outs. Separate controls are accessible to the patient in each side rail, but where the patient is incompetent, it is desirable to disable the patient controls and provide control only from a position which is accessible only to authorized people, thus the patient lock-outs.

Another objective of the present invention has been to provide for the movement of the headboard/work center from an inaccessible position at the end of the bed to an accessible position at either side at head end of bed. The movement of the headboard has the advantage of swinging the work center to a position that is completely accessible to the nurse in attendance and returning the work center to the end of the bed where it is normally adjacent the wall behind the patient. In the latter position, the elements of the work center are maintained inaccessible to all unauthorized persons and certain elements, such as a computer, are protected from damage.

Another objective of the invention has been to provide a pivoting headboard that hugs the sides or end of the bed as closely as possible so as to occupy as little extra floor space as possible while providing the pivoting headboard advantages.

A second advantage of the pivoting headboard/work center has been to provide direct access to the head of the patient during a code situation, a code situation being a traumatic condition such as cardiac arrest where access to the patient may be necessary from the head of the bed.

The objectives of the invention are attained by providing a pivot on the bed frame, a support mounted on the bed frame pivot and a headboard frame mounted on the support for sliding movement toward and away from the bed. A cam and cam follower connection between the bed frame and headboard frame causes the headboard to move in a predetermined path that is as close to the bed as possible while permitting the headboard to clear the corners of the bed when it swings from the end of the bed to the sides of the bed. The surface of the headboard, remote from the frame may be organized with a computer, diagnostic and treatment accessories, and bed controls as desired. Tailoring such organization to a hospital's requirements is contemplated.

Among the major advantages of the combination of the present invention are the following:

It provides a complete work nursing center without adding to the "footprint" of the bed, that is, the floor space required by the bed.

It permits access to the patient from the head of the bed.

It will save the nursing personnel a lot of time and steps by providing all of the nursing accessories in a very convenient place.

It locates the computer (when stored) in a protected position.

It provides for nurse controls that are inaccessible to unauthorized persons.

It opens up the foot of the bed, previously used for controls, patient chart and the like, to additional procedures.

In an alternative form of the invention, the headboard is mounted on a pedestal, the pedestal being mounted on the floor independently of the bed. In this form of the invention, the bed can be totally separated from the headboard so that the end of the bed where the headboard is normally mounted can be rendered totally free from obstruction to provide even more complete access to a patient during a code situation. The separable headboard advances the "pod" concept of heavy operating motors and mechanisms and can be used as a relatively lightweight transfer cart while its heavier components remain in the patient's room. See U.S. Pat. No. 4,592,104.

Further, the separable headboard/work center permits the headboard-mounted controls, including a computer, to remain connected to the hospital power source and other circuits when the bed is separated for the purpose of transferring the patient.

The several features and objectives of the present invention will become more readily apparent from the following detailed description taken in conjunction with the accompanying drawings in which.

Figure 1:
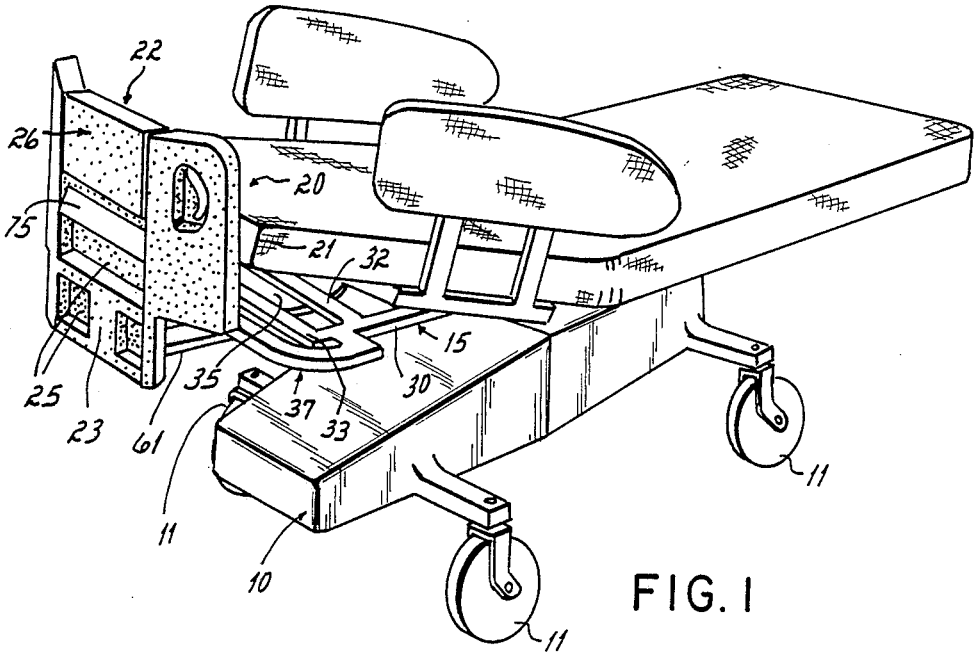
FIG. 1 is a perspective view of the invention applied to a hospital bed.

Referring to FIG. 1, the bed has a frame 10 which is mounted on casters 11. A bed frame 15 is provided to which the patient support panels are mounted. See application Ser. No. 7-034,232, filed Apr. 2, 1987, for details of the bed frame, patient supporting panels and operating controls, which patent application is specifically incorporated by reference to form a part of the present disclosure. The head end of the bed is indicated at 20. Its corner portions 21 are preferably slightly champfered or rounded off to permit a tight swinging path of the headboard with respect to the bed frame.

Figure 2:
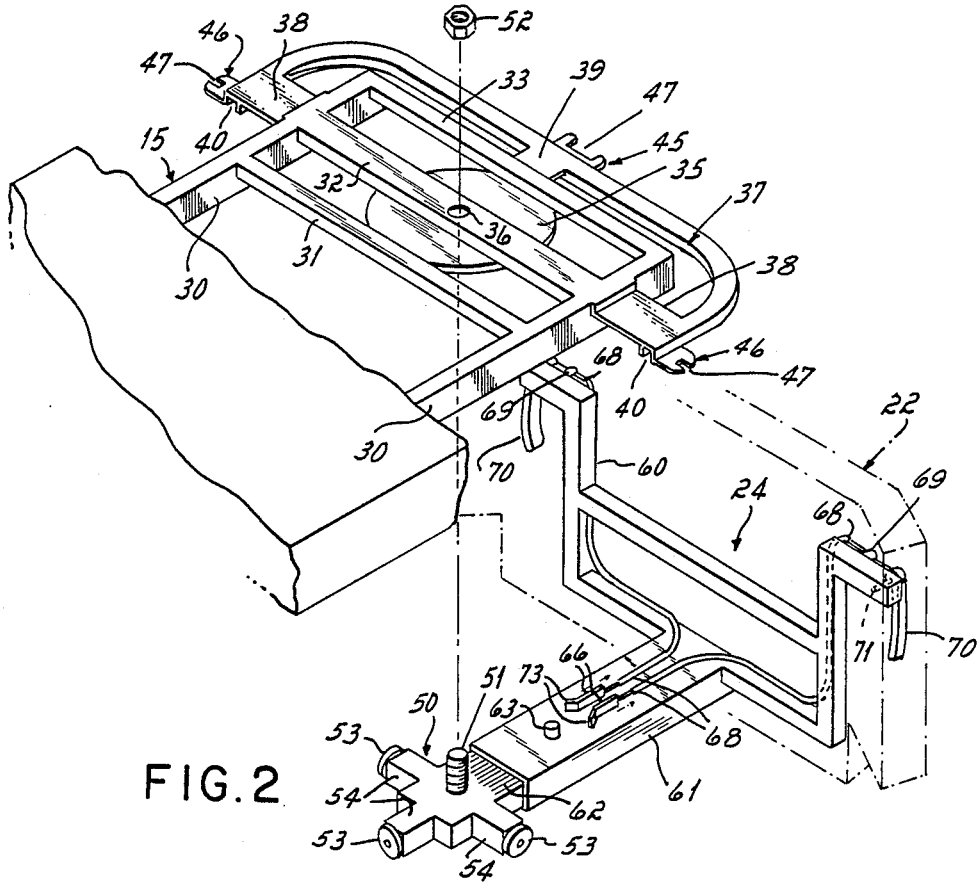
FIG. 2 is a disassembled, perspective view of the interconnection of the mechanical elements making up the pivoted headboard.
Figure 4:
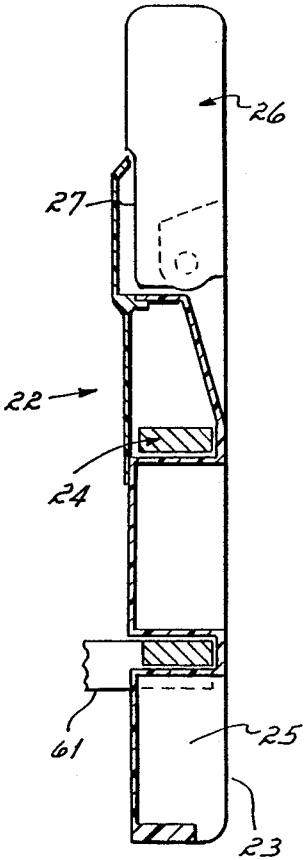
FIG. 4 is a cross-sectional view taken along lines 4—4 of FIG. 3.

A contoured headboard 22 is formed as a generally vertical wall 23 mounted on a pivoting head frame 24 (FIG. 2). The side of the headboard opposite the bed frame is provided with compartments 25 to receive the nursing accessories such as vital signs and measuring devices including stethoscope, blood pressure cuff, thermometer, and the like. A computer 26 having a keyboard 27 is mounted on the headboard. The keyboard is shown in a vertical attitude but can pivot to a horizontal attitude when in operation.

The bed frame 15 includes longitudinal members 30 and three transverse members 31, 32, and 33 at the head end of the bed. The transverse members support a pivot plate 35 having a central hole 36. A U-shaped cam track 37 is attached by brackets 38 at its ends and bracket 39 at its center to the bed frame. The cam track 37 has an inverted channel 40 in which a follower, to be described, rolls. A center lock catch 45 and two side catches 46 having recesses 47 are fixed to the cam track.

A support 50 having a threaded pivot post 51, is mounted under the plate 35 with the pivot post 51 passing through the opening 36 and secured thereto by a nut 52. Rollers 53 on cruciform bars 54 forming the support 50 engage the underside of the plate 35 to form a rolling antifriction contact between the support and the plate. The vertical headboard frame 24 having a vertical section 60 is slidably mounted on the support 50 by means of a rectangular sleeve 61 that is fixed to the vertical section 60 of frame 24 and is slidable on a horizontal bar 62 projecting from the support 50. The sleeve 61 is rigidly and integrally connected to said vertical section 60 and carries a roller 63 that rides in the channel 40 of the cam track 37.

Figure 3:
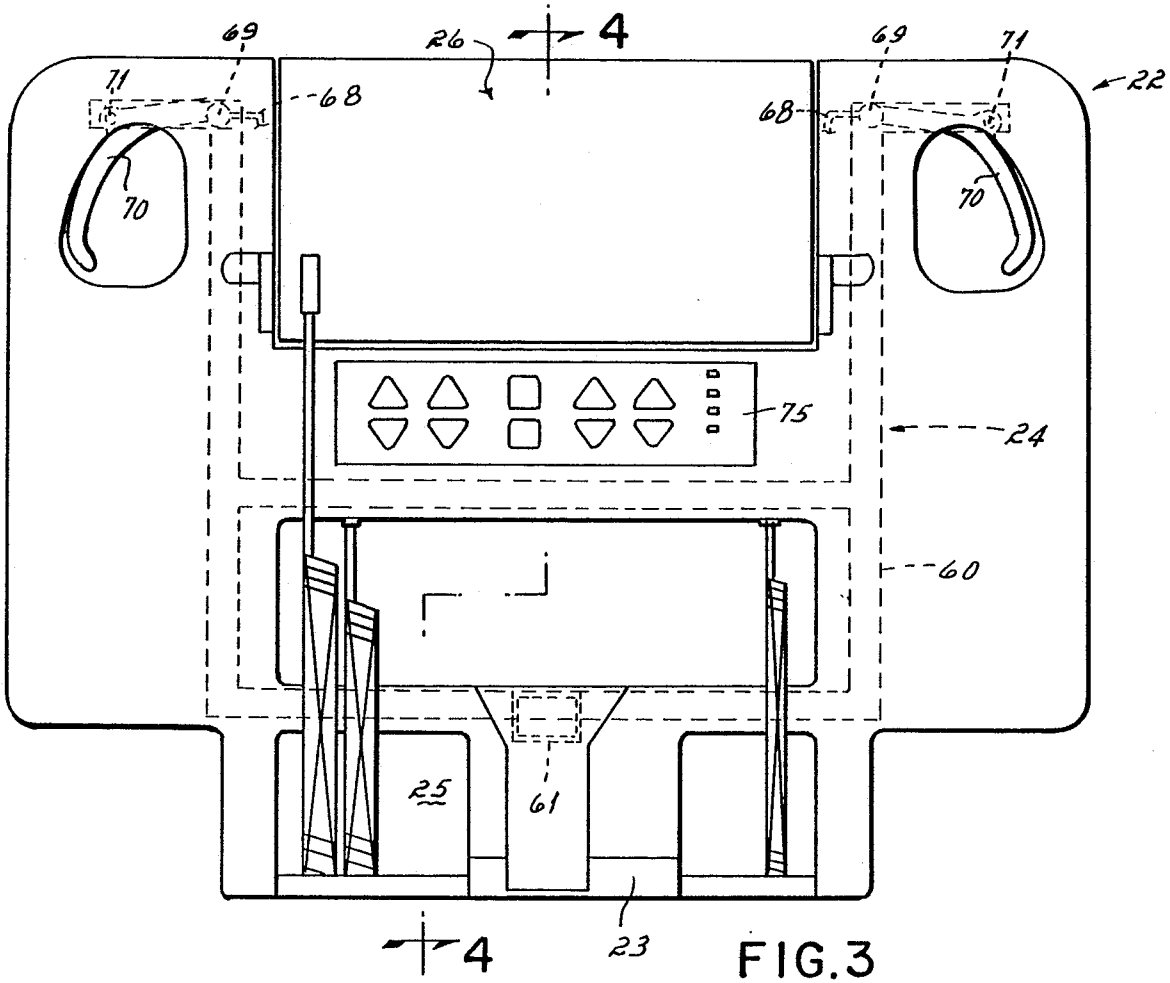
FIG. 3 is an end elevational view of the headboard.

The frame has the contoured headboard 22 shown in phantom lines in FIG. 2 and in elevation in FIG. 3, the headboard 22 being molded to the frame 24. A pair of locks 66 that are spring-loaded into their full line position shown in FIG. 2 are mounted on the sleeve 61 in a position to engage the lock catches 45 and 46. Each lock is attached to a cable 68 which is connected to the end 69 of a release handle 70. Release handle 70 is pivoted at 71 to the frame and is movable from the full line locked position to the broken line unlocked position wherein it pulls the lock to the broken line position shown in FIG. 2 to release it.

The end of each lock has a tapered surface 73 that permits the lock 66 to ride out of the center lock catch. If, when viewed from the foot end of the bed, the headboard is to be swung to the right side of the bed, the handle at the right side of the headboard is pivoted to release the lock 66 at the right side. This permits the headboard to swing in a clockwise direction as viewed from the top of the bed. The unreleased lock on the left side is cammed out of the lock catch by the tapered surface 73. When the headboard reaches its 90° position on the right side of the bed, the curved surface on the lock catch 46 cams the locks 66 and permits them to slide into latching position in the recess 47. Comparable manipulation of the locks is required to swing the headboard to the left side of the bed.

In the operation of the invention, the nurse, upon entering the patient's room, operates release handle 70 and swings the headboard work center from the head end of the bed to one side by pulling handle 70 toward her. The computer keyboard is flipped down exposing a screen. The nurse uses a bar code reader to enter her badge and the patient's wrist band into the computer. Time is automatically entered. Using the accessories mounted on the headboard, the patient's vital signs are taken and immediately recorded into the computer. If the patient is believed to be incompetent, the patient-operated bed controls are disabled and the nurse makes adjustments for the comfort and care of the patient using the controls mounted on the headboard as indicated at 75.

When the call upon the patient has been completed, the appropriate release handle 70 is operated and the headboard-work center is swung to its inoperative position at the head of the bed where the operating equipment is concealed and inaccessible to unauthorized persons by the bedroom wall.

In the embodiment just described, the headboard is carried with the bed. That has its disadvantages in situations where the bed is regularly moved from place to place in transferring the patient around the hospital. (See U.S. Pat. No. 4,592,104 for a hospital bed useful for traveling about a hospital.) One disadvantage is that delicate, expensive equipment such as a computer must be carried with the bed with probable damage when banged into hospital walls, doorways and the like. Another disadvantage is that there are at least four electrical connections that must be interrupted and reconnected when a move is made. Further, when a computer loses its power, data may be temporarily or permanently lost.

Figure 5:
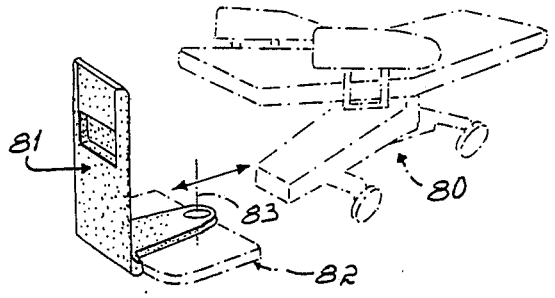
FIG. 5 is a perspective view of an alternative form of the invention.
Figure 6:
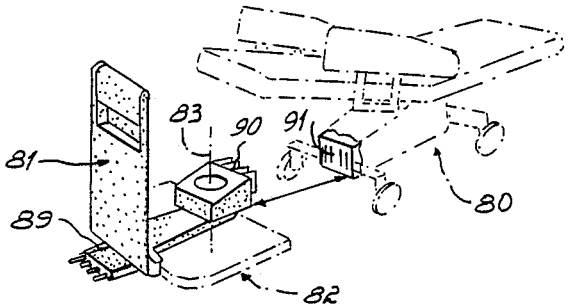
FIG. 6 is a modification of the alternative form of the invention.

An alternative form of the invention, which eliminates the foregoing disadvantages, is shown in FIGS. 5 and 6. In the embodiment of FIG. 5, a bed 80 has a headboard/control center 81 associated with it. The headboard/control center is mounted on a pedestal 82 for pivoting about an axis 83. It is contemplated that the pedestal and headboard will have support and cam track structure comparable to that of the previous embodiment to permit the headboard always to lie close to the bed. This headboard is electrically self-contained and does not have controls that are connected to the bed to operate it. While it contains a computer, the computer is electrically self-contained. In the embodiment of FIG. 6, a connector unit 90 is mounted on the pedestal 82 and contains electrical connections to all of the controls on the headboard/control center 81. A tail 89 projecting rearward from the pedestal contains all of the connections to be made to the hospital circuits—the power, nurse call, phone and computer power supply. A mating connector 91 is mounted on the bed 80. When the bed and pedestal are brought together to locate the headboard at one end of the bed, the electrical connection to all four systems is made by plugging the connector 90 into the connector 91. This modification may thus be provided with all of the controls for operating the bed, a telephone and the like. Power to the computer from the hospital circuits remains connected even though the bed is pulled away.

In the modifications of FIGS. 5 and 6, the pedestals 82 may be mounted on casters so that the pedestal, carrying with it the headboard/control center, can be moved away from the bed or, alternatively, the bed can be moved away from the pedestal.

Preferably, in both embodiments the headboard is pivotally mounted so that in the normal day-by-day routine, the headboard can be swung to the side of the bed to permit the nurse to perform the routine tasks associated with a patient visit. In code situations, however, the bed and headboard/control center are quickly separated to leave the space at the end of the bed totally unobstructed during the code situation procedures.

From the above disclosure of the general principles of the present invention and the preceding detailed description of a preferred embodiment, those skilled in the art will readily comprehend the various modifications to which the present invention is susceptible. For example, the mechanism of the present invention could be applied to the footboard of the bed, rather than the headboard. Therefore, we desire to be limited only by the scope of the following claims and equivalents thereof:

We claim:

1. An elongated hospital bed comprising:

an elongated frame having an end for a work center, a work center dimensioned to extend substantially across the end of said frame, means pivotally mounting said work center to said end of said frame, including an arm pivotally connected to a central interior portion of said frame and having a length extending from said connection to beyond the periphery of said frame adjacent said end allowing horizontal swinging motions of said work center across the end and both sides of said bed, whereby said work center can function as a headboard or footboard when at the end of said bed and can be swung to either side of said bed for the convenience of nursing procedures.

2. A bed as in claim 1 in which said work center includes a generally vertical wall, means forming compartments on the side of said wall remote from said bed to contain diagnostic devices and the like.

3. A bed as in claim 1 in which the bed has corners adjacent said work center that are arcuately formed to facilitate clearance of the bed corners when said work center is pivoted between positions.

4. An elongated hospital bed comprising:

a bed frame, a U-shaped cam track at one end of said bed, a headboard support pivotally mounted about a vertical axis on the end portion of said frame, a headboard frame mounted for horizontal sliding movement on said support, a cam follower mounted on said headboard frame and engaging said cam track, said cam track and follower cooperating to permit said headboard to clear the corners of said bed as said headboard is moved to positions at the end and sides of same frame.

5. A bed as in claim 5 further comprising: means for latching said headboard in positions at the head and at the side of said bed.

6. A bed as in claim 5 in which said latching means comprises:

a lock catch located at three spaced positions on said bed frame corresponding to the positions to which said headboard can be moved, and lock means slidably mounted on said headboard frame to cooperate with said lock catches, and at least one release handle for releasing said lock means from said catches.

7. A bed as in claim 6 in which said lock means comprises:

two spaced locks slidably mounted on said headboard frame, a release handle on each side of said headboard and each operable to release a respective one of said locks, enabling it to ride out of said catch when the other lock has been pulled out with said release handle.

8. A bed as in claim 4 in which said headboard frame has a vertical section and a horizontal sleeve, said horizontal sleeve being slidably mounted on said support, and a headboard molded on said vertical section.

9. An elongated hospital bed comprising:

an elongated frame having an end for a work center, a work center, a cam track on said frame, a follower on said work center disposed in said cam track, said cam track being configurated to guide said work center to positions closely adjacent the end and sides of said bed while permitting said work center to clear the corners of said bed, whereby said work center can function as a headboard or footboard across the end of said bed and can be swung to either side of said bed for the convenience of nursing procedures.

* * * * *

UNITED STATES PATENT AND TRADEMARK OFFICE

CERTIFICATE OF CORRECTION

PATENT NO. : 4,811,435

DATED : March 14, 1989

INVENTOR(S) : L. Dale Foster; Virgil J. Niese

It is certified that error appears in the above-identified patent and that said Letters Patent is hereby corrected as shown below:

Column 6, line 3, change "claim 5" to -- claim 4 -- .

Column 6, line 22, before "enabling," insert -- each lock having a tapered surface -- .

Signed and Sealed this

Sixteenth Day of January, 1990

*Attest:*

JEFFREY M. SAMUELS

*Attesting Officer*

*Acting Commissioner of Patents and Trademarks*